US009670423B1

(12) United States Patent
Amato et al.

(10) Patent No.: US 9,670,423 B1
(45) Date of Patent: Jun. 6, 2017

(54) SONAP UNIT : PORTABLE NAPHTHENIC ACID SPRINGING UNIT

(71) Applicant: SOCHEM SOLUTIONS, INC., Gonzales, LA (US)

(72) Inventors: Salvatore Anthony Amato, Baton Rouge, LA (US); Franklin Thad Woodward, Prairieville, LA (US); Mark Moen, Gray, LA (US)

(73) Assignee: SOCHEM SOLUTIONS, INC., Gonzales, LA (US)

( * ) Notice: Subject to any disclaimer, the term of this patent is extended or adjusted under 35 U.S.C. 154(b) by 452 days.

(21) Appl. No.: 14/204,774

(22) Filed: Mar. 11, 2014

Related U.S. Application Data

(60) Provisional application No. 61/776,196, filed on Mar. 11, 2013.

(51) Int. Cl.
*C10G 29/02* (2006.01)

(52) U.S. Cl.
CPC ..... *C10G 29/02* (2013.01)

(58) Field of Classification Search
CPC ..... C10G 29/02
See application file for complete search history.

(56) References Cited

U.S. PATENT DOCUMENTS

| | | | |
|---|---|---|---|
| 4,081,354 | A | 3/1978 | Christman |
| 5,011,579 | A | 4/1991 | Davis |
| 5,705,074 | A | 1/1998 | Brient |
| 5,985,137 | A | 11/1999 | Ohsol et al. |
| 6,063,266 | A | 5/2000 | Grande et al. |
| 7,504,023 | B2 | 3/2009 | Chamberlain Pravia et al. |
| 7,575,689 | B1 | 8/2009 | Panjala et al. |
| 7,833,499 | B2 | 11/2010 | Zang et al. |
| 8,137,565 | B2 | 3/2012 | Gong et al. |
| 8,277,639 | B2 | 10/2012 | Buchanan et al. |
| 2004/0134838 | A1 | 7/2004 | Maldonado et al. |
| 2006/0231490 | A1 | 10/2006 | Manna et al. |
| 2009/0057236 | A1 | 3/2009 | Sanchez et al. |
| 2011/0139687 | A1 | 6/2011 | Yeganeh et al. |

FOREIGN PATENT DOCUMENTS

EP 2164592 B1 3/2013

OTHER PUBLICATIONS

KH. Mohamadbeigy, M. Bayat, KH. Forsat, "Studying on the Jet Fuel Treating Plant for Maximum Efficiency," Petroleum & Coal 48 (3), 36-41, 2006.

B. Zhao, R. Currie, and H. Mian, "Catalogue of Analytical Methods for Naphthenic Acids Related to Oil Sands Operations," Oil Sands Research and Information Network, University of Alberta, School of Energy and the Environment, Edmonton, Alberta. OSRIN Report No. TR-21. 65 pp.

"Napfining™ Naphthenic acid removal" http://www.digitalrefining.com/literature/1000527,NAPFINING_Naphthenic_acid_removal.html#.U_UE16P4JxM.

*Primary Examiner* — Randy Boyer
*Assistant Examiner* — Juan Valencia
(74) *Attorney, Agent, or Firm* — Garvey, Smith, Nehrbass & North, L.L.C.; Seth M. Nehrbass; Mackenzie D. Rodriguez

(57) ABSTRACT

A portable unit along with a service is described to separate the organic acids in refinery brine (brine) without the high capital costs of a "fixed asset" processing plant or paying to have the entire brine stream hauled off site for organic acid recovery and waste water treatment. This will result in substantial cost savings and minimize the producers' exposure to risk.

22 Claims, 2 Drawing Sheets

SONAP UNIT : PORTABLE NAPHTHENIC ACID SPRINGING UNIT

CROSS-REFERENCE TO RELATED APPLICATIONS

This application claims the benefit of U.S. Provisional Patent Application Ser. No. 61/776,196, filed on Mar. 11, 2013, which is incorporated herein by reference. Priority of U.S. Provisional Patent Application Ser. No. 61/776,196, filed on Mar. 11, 2013 is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of Invention

This invention relates to the "springing" of organic acids, specifically crude Naphthenic Acid, on a refinery site rather than transporting these brine streams containing these acids for offsite separation.

2. General Background of the Invention

A process is described whereby the alkali scrubbing of Kerosene to strip it of its organic acids to create cleaner burning jet fuel. This creates large volumes of alkaline solution known as "refinery brine". These brine streams are currently transported via barge, rail or truck to a distant processing facility to recover the organic acids contents and treat the remaining 90% to 98% of the brine stream for release.

Transporting these streams from the refineries to a remote "fixed asset" processing plant for recovery and treatment is a costly expense for the industry, It also increases the transportation, environmental and personnel exposure risk. Alternative technologies for the springing of these products requires the capital cost of constructing a "fixed asset" processing plant, which is prohibitive in nature, and results in most producers to continue to seek the lower cost solution of transporting off site.

Thus an alternative method for springing the recoverable products on site and treating the resulting waste on site is being presented here to save operating cost, improve efficiency and reduce the risks factors associated with the transportation of these brines.

SUMMARY OF THE INVENTION

After researching and testing the process on a laboratory scale and subsequently building a "fixed asset" processing plant for testing on a large scale, we have designed a "skid" mounted or portable unit which can be transported by a single truck and virtually placed at any site that produces the brine, This "mini-plant" is a "plug and play" unit and fully automated. It eliminates the need to store, load and transport these brine streams for offsite recovery and treatment. The service offered with this unit is the periodic monitoring of the process, removal of the resulting naphthenic acid product and the pre-treatment of the resulting waste brine water before it enters into the existing on site waste water treatment system (i.e, neutralization of water).

DESCRIPTION OF THE DRAWING

The drawing shows a schematic of the process of this invention. It demonstrates the compact size and portability of the unit.

DETAIL DESCRIPTION OF THE INVENTION

Figure 1:
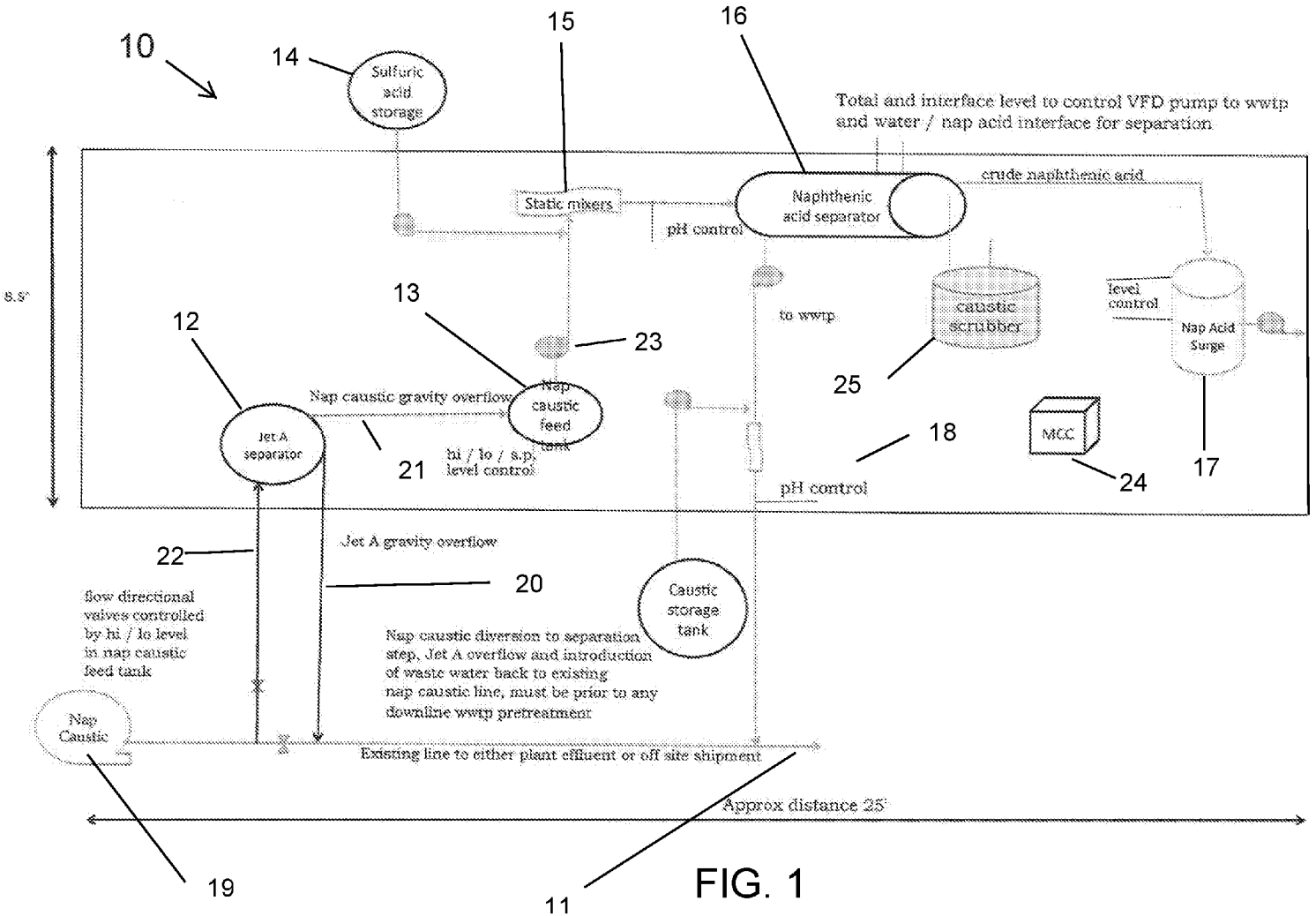
Figure 2:
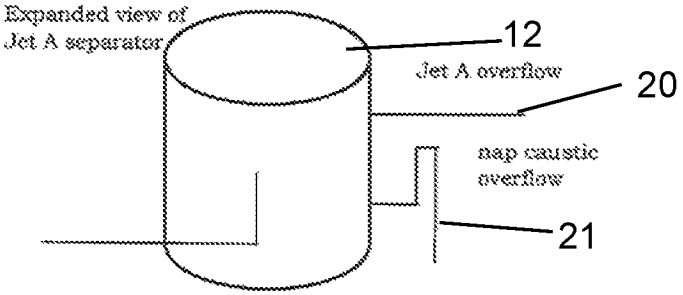

The invention provides a major improvement in the method of recovering the naphthenic acid from the refinery brine, the pretreatment of the resulting waste stream and the removal for sale of the resulting crude naphthenic acid.

The physical size of the skid-mounted unit has an extremely small footprint allowing it to be transported by normal trucking means to any location in the refinery with relative ease. The chemical injection points for Sulfuric Acid and Sodium Hydroxide will be common sized connections for fast installation. The electrical and instrumentation systems will be PLC based with a network connector to interface to the plants existing DCS system, if required, for remote monitoring and control.

The brine streams now going to existing storage tanks or effluent lines can be diverted to our unit's Jet A Separator to remove inadvertent jet fuel that would contaminate the brine and return it to the customer's existing effluent line (this jet fuel is processed, as before, in the customers WWTP). There is a detail of the Jet A separator on the drawing.

Once separated, the "nap caustic" will gravity feed into the Nap caustic feed tank. It will be pumped to the Naphthenic Acid separator while being injected with sulfuric acid and then pass through a series of inline static mixers. The ph set point will control the speed of the sulfuric acid pump to insure the target ph is maintained to ensure the proper "springing" of the naphthenic acid. The Naphthenic acid and primary water interface will be controlled by a series of level monitors, The crude naphthenic acid (approximately 2-10% of the incoming brine) will be continually skimmed from the top of the separators' liquid level and gravity feed into the nap acid surge tank. A total liquid level controller will maintain skimming volume. The surge tanks' electronic level control will activate a pump to transfer the crude naphthenic acid, as needed, to a staged tanker or other vessel for transportation to the end users. The transport tank will be equipped with a drop-in level control to shut down or alarm when it is near its capacity.

The caustic scrubber unit, shown in green on the drawing, will scrub any fumes that may be created. Vent hoses will be placed at all critical points that may have fumes present.

The primary water from the bottom of the separator will be pH 2.0. It will be pumped to the existing WWTP line based on interface level control in the separator.

The primary water waters' pH will be raised from 2.0 target to 7.5 target with Sodium Hydroxide. An inline pH meter will control pump speed to maintain target.

The MCC is the motor control center and will contain the PLC and other electrical breakers and switches. It will also contain the network connector to the plants' DCS system.

The present invention includes a method for separating hydrocarbons and springing naphthenic acid from a naphthenic caustic comprising:

a) connecting a portable skid-mounted naphthenic acid springing unit 10 to a refinery's or plant's existing DCS system;

b) using flow directional valves 19 controlled by hi/lo level in nap caustic feed tank 13, diverting the refinery's existing waste brine stream 11 to the portable skid-mounted unit 10; wherein the following steps occur:

i) the brine stream is sent via a brine flow line 22 through a separator 12 where jet fuel is removed and returned to the existing waste line 11 via jet A overflow line 20;

ii) the brine, which has been separated from jet fuel, is gravity fed into a nap caustic feed tank 13 via nap caustic gravity overflow line 21;

iii) brine from the nap caustic feed tank 13 is pumped from the nap caustic feed tank 13, injected with sulfuric acid from sulfuric acid storage 14 to lower the pH, passed through a series of inline static mixers 15, and into a naphthenic acid separator 16;

iv) naphthenic acid is skimmed off the top of the separator 16 and gravity fed into a naphthenic acid surge tank 17; and v) the remaining waste brine less the naphthenic acid is pumped from the bottom of the naphthenic acid separator 16 and injected with sodium hydroxide at pH control 18 to increase the pH; and c) returning the waste brine to the refinery's or plant's existing waste brine stream 11 after the naphthenic acid has been removed.

Preferably, the portable skid-mounted unit 10 further performs the steps of scrubbing any fumes that may be created with a caustic scrubbing unit, and venting those fumes with one or more vent hoses placed at all critical points that may have fumes present.

Preferably, in step iii) of the method performed by the skid-mounted unit 10, the pH of the nap caustic feed is lowered to a preferred pH that is controlled and maintained by a pH set point control 18.

Preferably, the pH set point control 18 controls and maintains the pH of the nap caustic feed by adjusting the speed at which sulfuric acid is injected.

Preferably, the pH is the optimal pH for proper "springing" of naphthenic acid.

Preferably, the pH is 2.0.

Preferably, in step v) performed by the skid-mounted control unit 10, the remaining waste brine pH is raised to a preferred pH that is controlled and maintained by an inline pH meter 18.

Preferably, the inline pH meter 18 controls and maintains the pH of the remaining waste brine by adjusting the speed at which sodium hydroxide is injected.

Preferably, the pH is the optimal pH for the refinery or plant's waste stream.

Preferably, the pH is 7.5.

Preferably, the skid-mounted unit further performs the step of transferring crude naphthenic acid from the naphthenic acid surge tank to a vessel for transportation to one or more end users.

Preferably, the transfer of crude naphthenic acid is performed by a pump, said pump being activated by an electronic liquid level control in the naphthenic acid surge tank.

Preferably, the vessel for transportation is equipped with a drop-in level control that will shut down or alarm when the vessel is near capacity.

Preferably, the vessel for transportation is a tanker.

Preferably, a method for separating hydrocarbons and springing naphthenic acid from a naphthenic caustic comprising, wherein the apparatus further includes the following:

means for diverting the refinery's existing brine stream to the jet fuel separator of the apparatus;

means for returning any separated jet fuel to the refinery's existing waste stream;

means (pump 23) for pumping the brine stream from the naphthenic caustic feed tank 13 through the static mixers 15 to the naphthenic acid separator 16; and means for connecting the motor control center 24 to the refinery's existing control system.

Preferably, the pH set point controls the rate at which sulfuric acid is injected into the brine stream as is it pumped from the naphthenic caustic feed tank through the static mixers to the naphthenic acid separator in order to maintain a preferred pH level for "springing" naphthenic acid.

Preferably, the pH level is 2.0.

Preferably, the one or more level controllers control the interface between the sprung naphthenic acid and the remaining waste brine, and the liquid level controller maintains skimming volume for the naphthenic acid skimming means.

Preferably, the caustic scrubber scrubs any fumes that may be created and those fumes are vented via the one or more vent hoses.

Preferably, the inline pH meter 18 controls the rate at which sodium hydroxide is injected into the remaining brine stream as is it pumped from the naphthenic acid separator to the refinery's existing waste line in order to maintain a preferred pH level for the refinery's waste.

Preferably, the pH level is 7.5.

Preferably, the portable skid-mounted naphthenic acid springing unit 10 comprises:

a separator for separating jet fuel from a refinery's existing brine stream 11;

a naphthenic caustic feed tank 13;

a sulfuric acid injector;

one or more static mixers 15;

a pH set point;

a naphthenic acid separator 16;

one or more level monitors;

a means for skimming naphthenic acid from the naphthenic acid separator 16;

a liquid level controller;

a naphthenic acid surge tank 17;

an electronic level control;

a caustic scrubber 25;

one or more vent hoses;

a naphthenic acid stage tank; and a primary water pump for pumping primary water from the bottom of the separator back to the refinery's existing waste line;

a sodium hydroxide injector;

an inline pH meter; and a motor control center 24.

PARTS LIST

10 portable skid-mounted naphthenic acid springing unit
11 refinery's existing waste brine stream
12 separator
13 nap caustic feed tank
14 sulfuric acid storage
15 a series of inline static mixers
16 naphthenic acid separator
17 naphthenic acid surge tank
18 pH control
19 flow directional valves
20 Jet A gravity overflow line

21 nap caustic gravity overflow line
22 brine flow line
23 pump
24 motor control center
25 caustic scrubber Acronyms:
DCS distributed control system
PLC programmable logic circuit
WWTP waste water treatment plant
VFD variable frequency drive

What is claimed is:

1. A method for separating hydrocarbons and springing naphthenic acid from a naphthenic caustic comprising:

a) connecting a portable skid-mounted naphthenic acid springing unit to a refinery's or plant's existing DCS system;

b) diverting the refinery's existing waste brine stream to the portable skid-mounted unit; wherein the following steps occur:

i) the brine stream is sent through a separator where jet fuel is removed and returned to the existing waste line;

ii) the brine, which has been separated from jet fuel, is gravity fed into a nap caustic feed tank;

iii) brine from the nap caustic feed tank is pumped from the nap caustic feed tank, injected with sulfuric acid to lower the pH, passed through a series of inline static mixers, and into a naphthenic acid separator;

iv) naphthenic acid is skimmed off the top of the separator and gravity fed into a naphthenic acid surge tank; and v) the remaining waste brine less the naphthenic acid is pumped from the bottom of the naphthenic acid separator and injected with sodium hydroxide to increase the pH; and c) returning the waste brine to the refinery's or plant's existing waste brine stream after the naphthenic acid has been removed.

2. The method of claim 1, wherein the portable skid-mounted unit further performs the steps of scrubbing any fumes that may be created with a caustic scrubbing unit, and venting those fumes with one or more vent hoses placed at all critical points that may have fumes present.

3. The method of claim 1, wherein in step iii) performed by the skid-mounted unit, the pH of the nap caustic feed is lowered to a preferred pH that is controlled and maintained by a pH set point control.

4. The method of claim 3, wherein the pH set point control controls and maintains the pH of the nap caustic feed by adjusting the speed at which sulfuric acid is injected.

5. The method of claim 3 wherein the preferred pH is the optimal pH for proper "springing" of naphthenic acid.

6. The method of claim 3, wherein the preferred pH is 2.0.

7. The method of claim 1, wherein in step v) performed by the skid-mounted control unit, the remaining waste brine pH is raised to a preferred pH that is controlled and maintained by an inline pH meter.

8. The method of claim 7, wherein the inline pH meter controls and maintains the pH of the remaining waste brine by adjusting the speed at which sodium hydroxide is injected.

9. The method of claim 7 wherein the preferred pH is the optimal pH for the refinery or plant's waste stream.

10. The method of claim 7 wherein the preferred pH is 7.5.

11. The method of claim 1 wherein the skid-mounted unit further performs the step of transferring crude naphthenic acid from the naphthenic acid surge tank to a vessel for transportation to one or more end users.

12. The method of claim 11 wherein the transfer of crude naphthenic acid is performed by a pump, said pump being activated by an electronic liquid level control in the naphthenic acid surge tank.

13. The method of claim 11 wherein the vessel for transportation is equipped with a drop-in level control that will shut down or alarm when the vessel is near capacity.

14. The method of claim 13 wherein the vessel for transportation is a tanker.

15. The method of claim 1, wherein the portable skid-mounted naphthenic acid springing unit comprises:

a separator for separating jet fuel from a refinery's existing brine stream;
a naphthenic caustic feed tank;
a sulfuric acid injector;
one or more static mixers;
a pH set point;
a naphthenic acid separator;
one or more level monitors;
a means for skimming naphthenic acid from the naphthenic acid separator;
a liquid level controller;
a naphthenic acid surge tank;
an electronic level control;
a caustic scrubber;
one or more vent hoses;
a naphthenic acid stage tank; and
a primary water pump for pumping primary water from the bottom of the separator back to the refinery's existing waste line;
a sodium hydroxide injector;
an inline pH meter; and
a motor control center.

16. The method of claim 15, wherein the apparatus further includes the following:

means for diverting the refinery's existing brine stream to the jet fuel separator of the apparatus;
means for returning any separated jet fuel to the refinery's existing waste stream;
means for pumping the brine stream from the naphthenic caustic feed tank through the static mixers to the naphthenic acid separator; and
means for connecting the motor control center to the refinery's existing control system.

17. The method of claim 16 wherein the pH set point controls the rate at which sulfuric acid is injected into the brine stream as is it pumped from the naphthenic caustic feed tank through the static mixers to the naphthenic acid separator in order to maintain a preferred pH level for "springing" naphthenic acid.

18. The method of claim 17 wherein the preferred pH level is 2.0.

19. The method of claim 16 wherein the one or more level controllers control the interface between the sprung naphthenic acid and the remaining waste brine, and the liquid level controller maintains skimming volume for the naphthenic acid skimming means.

20. The method of claim 16 wherein the caustic scrubber scrubs any fumes that may be created and those fumes are vented via the one or more vent hoses.

21. The method of claim 16 wherein the inline pH meter controls the rate at which sodium hydroxide is injected into the remaining brine stream as is it pumped from the naphthenic acid separator to the refinery's existing waste line in order to maintain a preferred pH level for the refinery's waste.

22. The method of claim 21 wherein the preferred pH level is 7.5.

* * * * *